United States Patent [19]

Huang

[11] Patent Number: 5,038,842

[45] Date of Patent: Aug. 13, 1991

[54] NESTING BAG

[76] Inventor: Yueh Huang, P.O. Box 22799, Taipei, Taiwan

[21] Appl. No.: 427,579

[22] Filed: Oct. 27, 1989

[51] Int. Cl.[5] ..... A45C 7/00; A45C 13/00; A45C 13/10; A45C 13/26

[52] U.S. Cl. ..... 150/113; 150/111; 150/117; 190/105; 190/108; 190/110; 190/111; 220/8

[58] Field of Search ..... 190/103-105, 190/108, 110, 111; 383/2, 61; 220/8; 150/113, 117

[56] References Cited

U.S. PATENT DOCUMENTS

| | | | |
|---|---|---|---|
| 179,745 | 7/1876 | Blake | 190/103 |
| 584,279 | 6/1897 | Wallace | 190/105 |
| 637,997 | 11/1899 | Russell | 190/105 |
| 672,143 | 4/1901 | Boughner | 190/104 |
| 968,479 | 8/1910 | Jensen | 190/104 |
| 2,079,476 | 5/1937 | Saling | 190/105 |
| 3,292,747 | 12/1966 | Dawson | 190/103 |
| 3,963,102 | 6/1976 | Carp | 190/108 |
| 4,008,790 | 2/1977 | Eiteljorg, III | 190/111 X |
| 4,212,377 | 7/1980 | Weinreb | 190/110 |
| 4,773,515 | 9/1988 | Kotkins, Jr. | 190/103 |

FOREIGN PATENT DOCUMENTS

| | | | |
|---|---|---|---|
| 163921 | 11/1954 | Australia | 190/104 |
| 288651 | 11/1988 | European Pat. Off. | 190/103 |
| 2654637 | 6/1978 | Fed. Rep. of Germany | 383/61 |
| 1557297 | 2/1969 | France | 190/103 |

*Primary Examiner*—Sue A. Weaver

[57] ABSTRACT

A nesting bag comprises a 3-bag combination and a strap. The three bags of the combination are so dimensioned that they are slidably disposed within one another, leaving two suitable spaces between the bottoms of the inner and middle bags as well as between the bottoms of the middle and outer bags respectively. The spaces grow larger when and after the inner and middle bas are pulled upwards relative to the middle and outer bags respectively. U-shaped zippers are horizontally provided on the top and bottom of the inner bag and on the bottom of the middle bag. When these zippers are pulled closed, the three bags can be used separately and when they are pulled open, the three bags can be used as a single, larger unit, instead. A U-shaped zipper is vertically provided on one side of the outer bag for conveniently putting objects into and taking them out of the outer bag. The strap has its stiff segments fixed on the end sides of the outer bag and its soft segments provided with button holes for holding the inner and middle bags in position when the bags have slid upwards.

7 Claims, 2 Drawing Sheets

NESTING BAG

SUMMARY OF THE INVENTION

The present invention relates to a bag, particularly to a nesting bag which offers the user unmatched convenience in using as well a carrying of it.

A conventional bag usually has only one large compartment which can hardly be enlarged at will. Besides, to put objects of different qualities in the same compartment of it will inevitably cause damage of soft objects by hard objects. For instance, glass objects will always receive damage from metal objects Then a conventional bag which even has more than one compartment does not provide as many conveniences as one would desire. For one thing, as such bag usually is quite bulky and clumsy, the user has to tolerate the inconvenience of carrying it awkwardly even though not much of its space is in use.

The present invention overcomes the problems with a conventional bag by providing a nesting bag which chiefly includes a multi-bag combination, which can either be used as a single unit, or as several separate units.

Another object of the present invention is to provide a nesting bag, the compartments of which can be enlarged when necessary.

Still another object of the present invention is to provide a nesting bag, the overall size of which is adjustable for easy and convenient carrying and storing.

A further object of the present invention is to provide a nesting bag, the middle compartment of which offers an extraordinarily safe place for valuables.

Other objects, features and advantages of the present invention will be set forth in the following description and drawings which illustrate the preferred embodiments thereof, with the understanding that the above statement of the objects of the present invention is intended generally to explain the same without limiting it in any manner. In addition, where the term "bag" is used in the description, the term "case" is likewise applicable.

REFERRING NOW TO THE DRAWINGS

DETAILED DESCRIPTION OF THE PREFERRED EMBODIMENT

Figure 1:
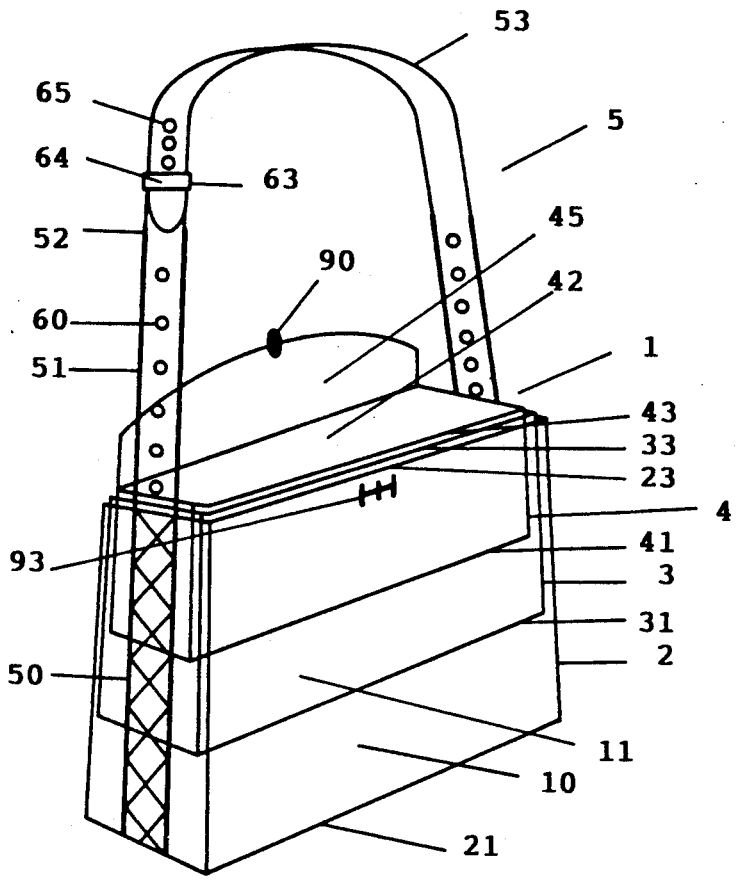
FIG. 1 illustrates a nesting bag of the present invention in a normal, closed position.
Figure 3:
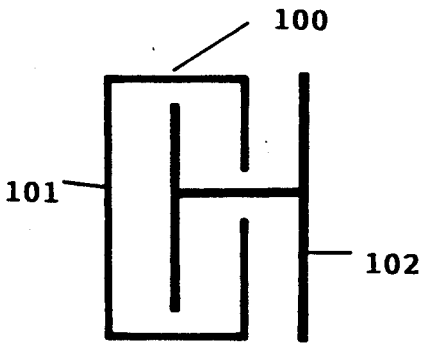
FIG. 3 illustrates a two-part sliding set mounted between two corresponding sides of bag members.
Figure 2:
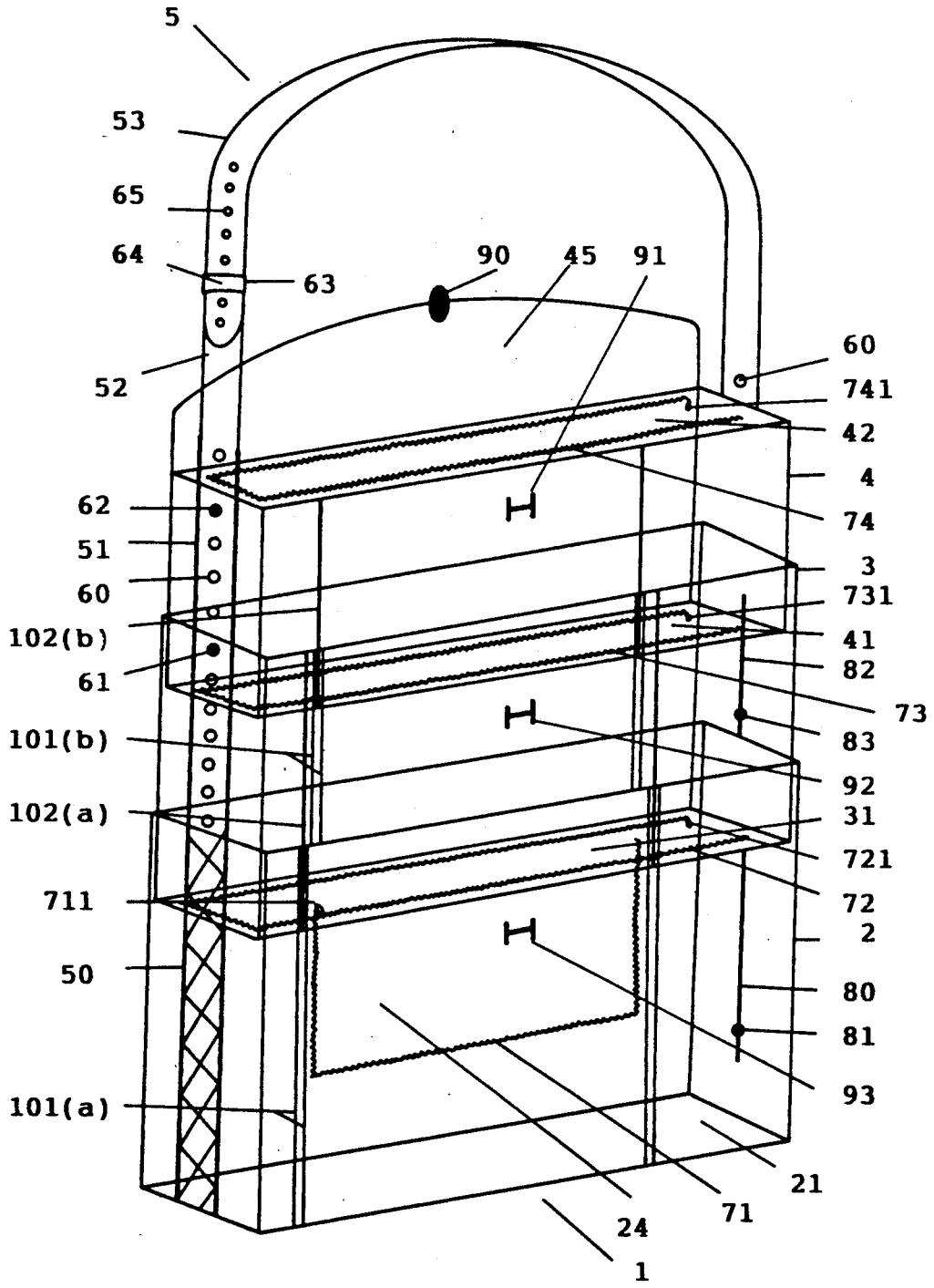
FIG. 2 illustrates the nesting bag in an extended position.

As shown in FIG. 1, an embodiment of the present invention comprises a 3-bag combination 1 and a strap 5: said 3-bag combination 1 consists of an outer bag 2, a middle bag 3 and an inner bag 4, each bag having a front side, a back side, two end sides and a bottom and said inner bag 4 also having a top 42 and a top cover 45; said inner bag 4 nests or fits within said middle bag 3 and the four sides of said inner bag 4 are shorter than those of said middle bag 3 in height so that a suitable space 11 is formed between said inner bag bottom 41 and said middle bag bottom 31; said middle bag 3, in turn, nests or fits within said outer bag 2 and the four sides of said middle bag 3 ar shorter than those of said outer bag 2 in height so that a suitable space 10 is formed between said middle bag bottom 31 and said outer bag bottom 21; long-slender decorative bars 43, 33 and 23 are provided over the top borders of the front and back sides of said inner, middle and outer bags respectively; when said 3-bag combination 1 is set in a normal, closed position as shown by FIG. 1, said decorative bars 43 will rest on said decorative bars 33, which, in turn, will rest on said decorative bars 23; said strap 5 consisting of two lower portions 50, two middle portions 51 and two upper portions 52 and 53 (53 being longer than 52) has its two lower portions 50 fixed to the outer surfaces of the two end sides of said outer bag 2, and a plurality of button holes 60 provided on its middle portions 51, each portion being in length approximately the total of the height of a middle bag side plus the height of an inner bag side; a buckle 63 provided at the end of said upper portion 52, which has a movable pin at its center, and a plurality of pin holes 65 provided at the end section of said upper portion 53; when the end section of said upper portion 53 enters said buckle 63 and let said pin 64 get into one of its pin holes 65, said upper portions 52 and 53 will at once unite and form a complete strap for use and by using different pin holes 65 on said portion 53, the overall length of said strap 5 can easily be adjusted. As shown in FIG. 2, one pair each of sliding set 100 is provided between the corresponding front sides and back sides of said inner bag 4 and middle bag 3 as well as between said middle bag 3 and outer bag 2, all in the vicinity of end sides; said sliding set 100 comprises a U-shaped slide guide 101 and an I-shaped slide rail 102, as shown in FIG. 3, and said U-shaped slide guide 101 is so made that both its two edges bend inwards towards the center and face but not meet each other so that a slideway (or trough) and a slide passage are formed; said I-shaped slide rail 102 comprising two bars and a connecting axle between them has one of the bars so made in size that it will easily enter the slideway of said slide guide 101 and move up and down freely therein, and the axle of said slide rail 102 is so made in size that it will easily enter the slide passage of said slide rail 102 and move up and down freely therein, and when used together said slide guide 101 and slide rail 102 will serve to keep the corresponding sides of said inner and middle bags as well as of said middle and outer bags suitably close to each other, and also to enable said inner bag and middle bag to move up and down freely and engagedly relative to said middle and outer bags respectively; said slide guide 101 is normally mounted on the inside surface of said outer and middle bags (101 *a* and 101 *b*) and said slide rail on the outer surface of said middle and inner bags (102*a* and 102*b*). One piece each of U-shaped zipper is horizontally provided on top 42 and bottom 41 of said inner bag 4 as well as on bottom 31 of said middle bag 3; said U-shaped zipper normally runs around the two lateral sides and one end side of a bag and has its sliding piece to start and end at points near the other end side of the bag, and when zipper 74 (with a sliding piece 741) and zipper 73 (with a sliding piece 731) on the top and bottom of said inner bag 4 and zipper 72 (with a sliding piece 721) on the bottom of said middle bag 3 are all pulled closed, said inner bag 4, middle bag 3 and outer bag 2 can all be used separately and when the three said zippers are all pulled open, the three said bags will unite and form a single, larger bag for use.

One piece of U-shaped zipper 71 (with a sliding piece 711) is also vertically provided on the back or front side of said outer bag 2, at a suitable place between the two slide guides 101*a*, having its sliding piece 711 both to start and end at suitable points below the top border of the side as well as above the bottom 31 of said middle bag 3 when and after said middle bag 3 has slided upwards, and having its bottom portion lying at a suitable place below the bottom 31 of said middle bag 3 when said middle bag 3 is not slided up, so that articles can conveniently and directly be put into and taken out of said outer bag 2, yet stealing from said outer bag 2 can be prevented because of the relative long distance said sliding piece 711 has to travel before said zipper 71 will be pulled open.

Figure 4:
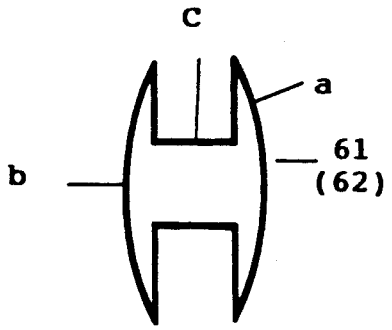
FIG. 4 illustrates a button provided on the end side of a bag.

Soft, pendent strap 82 having a button hole at one of its ends is provided on either end side of said inner bag 4, having its other end fixed at a suitable point on the lower outer surface of said inner bag 4, and a corresponding button 83 provided on either end side of said middle bag 3, fixed at a suitable point on the lower inner surface of the end side of said middle bag 3, and when said strap 82 is fastened to button 83 with its end with a button hole, it will prevent said inner bag 4 from coming off said middle bag 3 while sliding upwards relative to said middle bag 3; similar soft, pendent straps 80 and corresponding buttons 81 are provided between the end sides of said middle and outer bags for preventing said middle bag 3 from coming off said outer bag 2 while sliding upwards relative to said outer bag 2. I-shaped button 62 consisting of two tiny disks a and b and a short axle c between them, as shown in FIG. 4, is provided on either end side of said inner bag 4, at a suitable location in the upper center of the end side, said disk b, with its inner surface, fixed to the inner surface of the end side and said axle c passing the end side through a hold made at a suitable location in it, and said disk a appearing beside said end side, ready for going through one of button hole 60 on middle portion 51 of said strap 5; similarly, I-shaped button 61 is provided on either end side of said middle bag 3 for the same purpose; Top cover 45, being an extension of the back side of said inner bag 4, is provided to go over top 42 and reach a suitable location of the front side of said bag 4; tongue-shaped fastening piece 90 is provided at the tip of said top cover 45 and corresponding catching piece 91, in addition, provided at a suitable point of the front side of said inner bag 4, and when fastening piece 90 enters catching piece 91, they will function to keep top cover 45 to closely and tightly cover top 42; besides, catching pieces 92 and 93 are mounted on the front sides of said middle and outer bags respectively for use when said middle and outer bags have slided upwards.

Lower portion 50 of said strap 5, as will be fixed to the end side of said outer bag 2, and middle portion 51, which has button holes 60 on it, should be so made that they are strong enough to hold up-slided bags in position, and upper portions 52 and 53 so well made that they are as soft as possible for comfortable carrying. In the practical use of the present invention, it is appropriate to set the 3-bag combination 1 in a normal closed position, as shown in Fig, if not much spaces are needed. In this case, cheap and common articles can be put into said outer bag 2 by using zipper 71, valuables into said middle bag 3 by using zippers 74 and 73 and other articles into said inner bag 4; in case more spaces are needed of the bags, just have said inner and middle bags 4 and 3 slided up and held in position by buttons 61 and 62 and button holes 60. If still more space is needed for a large object, which can hardly be contained in one or two bags alone, simply pull all the zippers open.

What is claimed is:

1. A nesting bag comprising a 3-bag combination and a strap: said 3-bag combination chiefly consists of an inner bag being dimensioned to be received within a middle bag which in turn is dimensioned to be received within an outer bag, each bag having a front side, a back side, two end sides and a bottom, and the inner bag also having a top and a top cover; said inner bag slidably nests or fits within said middle bag and the four sides of said inner bag are shorter than those of said middle bag in height so that a first suitable space is formed between the bottoms of said inner and middle bags, and said middle bag slidably nests or fits within said outer bag and the four sides of said middle bag are shorter than those of said outer bag in height so that a second suitable space is formed between the bottoms of said middle and outer bags; long, slender decorative bars are provided over the top borders of the front and back sides of said inner, middle and outer bags, and when said bag combination is set in a normal, closed position wherein the bags are nested, the decorative bars are dimensioned such that the decorative bars of said inner bag will rest on those of said middle bag, which sill in turn rest on those of said outer bag; sliding means comprising two pairs of cooperating sliding members are provided between the facing inner and outer surfaces of the corresponding front and back sides of said inner and middle bags, as well as between the facing inner and outer surface of the corresponding front and back sides of the middle and outer bags, with one pair of the copending sliding members placed in the vicinity of each of the two end sides of the bags, serving to keep the corresponding sides suitably close to each other and also to enable the inner-placed bag sides to move up and down freely and engagedly relative to their respective outer-placed bag sides; and when said inner and middle bags have slid upwards, the two spaces formed between the bottoms of said inner and middle bags as well as between the bottoms of said middle and outer bags will grow larger so that more objects can be held therein; said strap consists of two portions, each portion comprising a lower segment, a middle segment and an upper segment, one of said portions being relatively short and the other of said portions being relatively long; said strap having its two lower segments fixed to outer surfaces of the two end sides of said outer bag, and a plurality of button holes provided on its two middle segments, which together with buttons provided on the end sides of said inner and middle bags, serve to hold said inner and middle bags in position when and after said bags have slid upwards; a buckle having a movable pin in its center is fixed to one end of the short upper segment and a plurality of pin holes provided on the long upper segment, and when the long upper segment enters the buckle and lets the pin of the buckle on the short upper segment get into one of its pin holes, the two portions will unite as one for use.

2. A nesting bag, as claimed in claim 1, wherein said cooperating sliding members provided between the corresponding sides of said inner and middle bags as well as between the sides of said middle and outer bags consists of a U-shaped slide guide and an I-shaped slide rail; the U-shaped slide guide has its two edges bent inwardly, to face yet not to meet with each other, so that a suitable slideway and a slide passage are formed; the I-shaped slide rail comprising two bars and a connecting axle, has one of its bars so made in size that it will easily enter said slideway and move freely therein, and said axle so made in size that it will easily enter said slide passage and move freely therein; when used together, said slide guide and slide rail will serve to keep the corresponding sides of the bags suitably close to each other, and also to enable the inner-placed bags to move freely and engagedly relative to their respective outer-placed bags.

3. A nesting bag, as claimed in claim 1, wherein one piece each of a U-shaped zipper is horizontally provided on the top and the bottom of said inner bag as well as on the bottom of said middle bag; when said zippers are pulled closed, said inner bag, middle bag and outer bag will all be able to be used separately and when said zippers are pulled open, the three bags will become united and form a single, larger bag for use.

4. A nesting bag, as claimed in claim 1, wherein a U-shaped zipper is vertically provided on at least one of the said front and back sides of said outer bag so that objects can be put into and taken out of said bag directly; said U-shaped zipper is so positioned that its sliding piece will both start and end at points which are well above the opening line or the bottom of said zipper, wherein said bag will not be zipped open until said sliding piece has travelled a rather long distance, thereby to serve as a deterrent to stealing from said bag.

5. A nesting bag, as claimed in claim 1, wherein one piece each of soft pendent strap is provided at a suitable lower point of the outer surface of at least one of said end sides of said inner bag, and a corresponding button is provided at a suitable lower point of the inner surface of the corresponding end side of said middle bag; when said pendent strap is fastened to said corresponding button, the two will serve to prevent said inner bag from coming off said middle bag when said inner bag moves upwards relative to said middle bag; the same type of soft pendent straps and corresponding buttons are provided between said middle and outer bags for preventing said middle bag from coming off said outer bag when said middle bag slides upwards relative to said outer bag.

6. A nesting bag, as claimed in claim 1, wherein a pair of cooperating fasteners are provided between the top cover and the front side of said inner bag for causing said top cover to closely and tightly cover the top of said inner bag when necessary; a cooperating fastener identical to that provided on the front side of the inner bag is also provided on the front side of said middle bag as well as on the front side of said outer bag, to be used to secure the top cover when at least one of said inner and middle bags have slid upwards.

7. A nesting bag, as claimed in claim 1, wherein the lower and middle segments of said strap are made of a material having sufficient strength to hold said inner and middle bags in position when and after they have slid upwards; the upper segments of said strap are made of a soft material so that they can comfortably be used.

* * * * *